US007578286B2

(12) United States Patent
Baumann et al.

(10) Patent No.: US 7,578,286 B2
(45) Date of Patent: Aug. 25, 2009

(54) PROCEDURE FOR THE FUNCTIONAL DIAGNOSIS OF AN ACTIVATEABLE FUEL TANK VENTILATION VALVE OF A FUEL TANK SYSTEM OF AN INTERNAL COMBUSTION ENGINE

(75) Inventors: Andreas Baumann, Milford, MI (US); Andreas Mueller, Pforzheim (DE); Andreas Pape, Gerlingen (DE); Ralf Gal, Vaihingen/Enz (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/656,682

(22) Filed: Jan. 23, 2007

(65) Prior Publication Data

US 2007/0267001 A1 Nov. 22, 2007

(30) Foreign Application Priority Data

Jan. 23, 2006 (DE) ..... 10 2006 003 041

(51) Int. Cl.
*F02M 33/02* (2006.01)

(52) U.S. Cl. ..... 123/520; 123/518

(58) Field of Classification Search ..... 123/520, 123/519, 518, 516

See application file for complete search history.

(56) References Cited

U.S. PATENT DOCUMENTS 5,680,849 A * 10/1997 Morikawa et al. ..... 123/520
5,699,778 A * 12/1997 Muraguchi et al. ..... 123/698
7,007,684 B2 * 3/2006 Itakura et al. ..... 123/698
2002/0129797 A1 * 9/2002 Hayashi et al. ..... 123/520
2002/0129802 A1 * 9/2002 Hayashi et al. ..... 123/698
2003/0140901 A1 * 7/2003 Amano et al. ..... 123/520

FOREIGN PATENT DOCUMENTS

DE 43 19 772 A1 12/1994
DE 102 20 223 B4 12/2003

* cited by examiner

*Primary Examiner*—Stephen K Cronin
*Assistant Examiner*—J. Page Hufty
(74) *Attorney, Agent, or Firm*—Merchant & Gould P.C.

(57) ABSTRACT

In a procedure for the functional diagnosis of an activateable fuel tank ventilation valve of the fuel tank system of an internal combustion engine, especially of a motor vehicle, whereby in specifiable time intervals when the fuel tank ventilation valve is activated to open, regeneration gas is added to the air drawn into the combustion chamber, whereby fuel is delivered to the combustion chamber, whereby the fuel, the air, respectively the fuel, the air and the regeneration gas are combusted in the combustion chamber and whereby by comparison of at least one operating parameter, which characterizes the combustion of fuel and intake air with the corresponding operating parameter, which characterizes the combustion of fuel, intake air and regeneration gas, inference can be made about the functional capability of the fuel tank ventilation valve, the HC-concentration of the regeneration gas is specifically affected by changing the regeneration gas stream.

9 Claims, 3 Drawing Sheets

Figure 1:
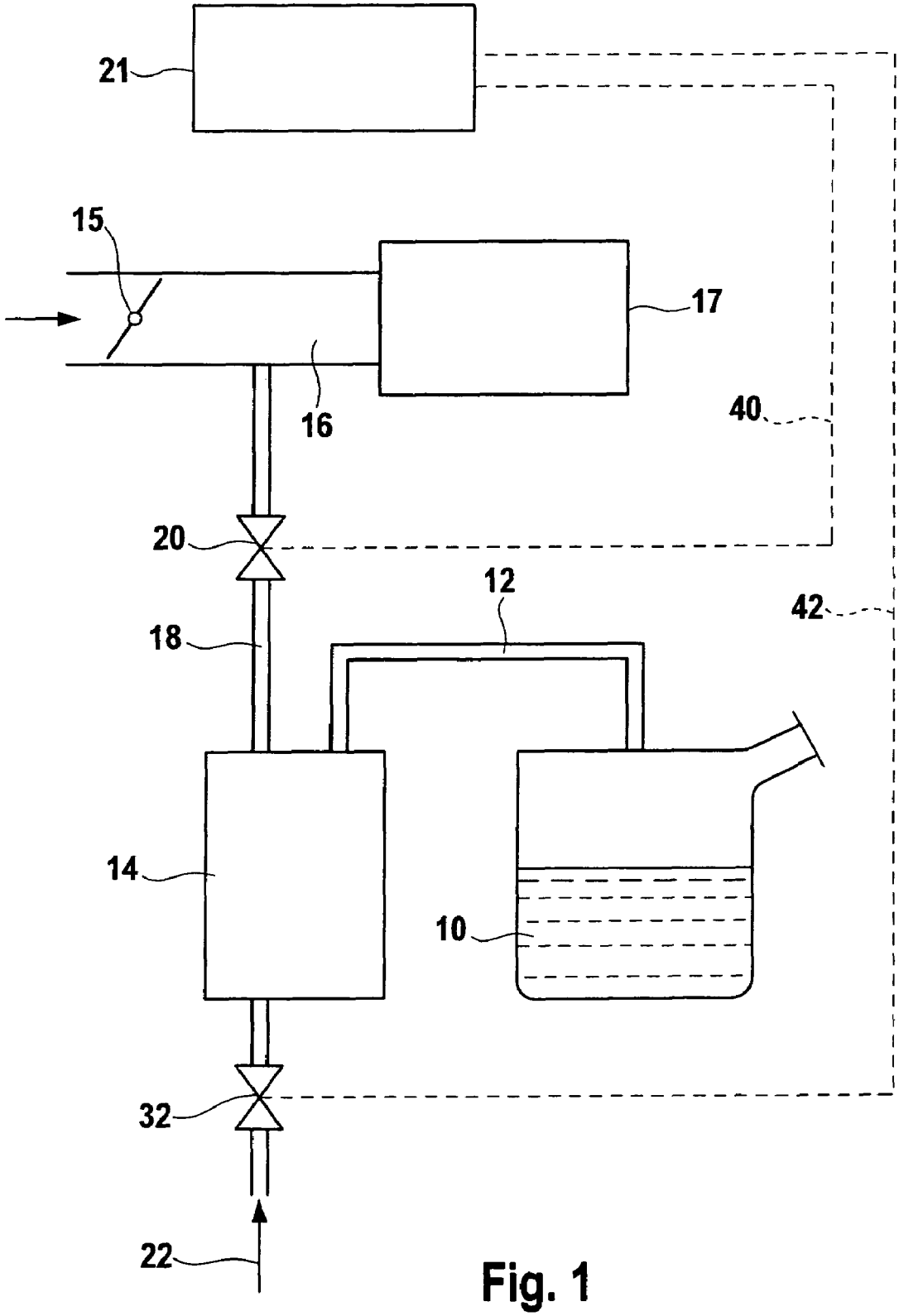

PROCEDURE FOR THE FUNCTIONAL DIAGNOSIS OF AN ACTIVATEABLE FUEL TANK VENTILATION VALVE OF A FUEL TANK SYSTEM OF AN INTERNAL COMBUSTION ENGINE

The invention concerns a procedure for the functional diagnosis of an activateable fuel tank ventilation valve of a fuel tank system of an internal combustion engine, especially of a motor vehicle, whereby in specified time intervals regeneration gas is added to the air drawn into a combustion chamber, whereby fuel is delivered to the combustion chamber, whereby the fuel and the air, respectively the fuel, the air and the regeneration gas are combusted in the combustion chamber and whereby inference is made about the functional capability of the fuel tank ventilation valve by comparison of at least one of the operational parameters characteristic of the combustion of fuel and intake air with the corresponding operational parameter characteristic of the combustion of fuel, intake air and regeneration gas.

A procedure and a control unit for the functional diagnosis of an activateable fuel tank ventilation valve to ventilate a fuel tank system of an internal combustion engine with $\alpha$-n-based fill registration, especially of a motor vehicle, was, for example, made known from the German patent DE 102 20 223 B4.

In this procedure, the reaction of an idle control normally provided in the internal combustion engine is evaluated to diagnose the functional efficiency of a fuel tank ventilation valve of a $\alpha$-n-based internal combustion engine. The procedure makes use of the technical effect, that during opening of the tank ventilation valve by the additional supply of the fuel-oxygen-mixture, an increased energy supply and with it an increased engine rotational speed result, which can be used to evaluate the function of the fuel tank ventilation valve. A procedure according to class, during which inference can be made about the functional efficiency of a fuel tank ventilation valve with the aid of a mixture control, proceeds additionally from the German patent DE 43 19 772 A1.

In such procedures the diagnosis of the fuel tank ventilation valve is based on the reaction of the mixture control to the opening of the fuel tank ventilation valve, especially the $\lambda$-closed loop control. The fuel tank ventilation valve is in this case actively controlled to open without sending a signal to the mixture control. Inference is made about the condition of the fuel tank ventilation valve from the reaction of the mixture control. The idea at the basis of this process is that the HC-concentration in the regeneration gas, which is introduced, does not correspond as a rule to the HC-concentration of the fuel-air mixture adjusted by the $\lambda$-closed loop control. The values derived from the reaction of the $\lambda$-closed loop control can, therefore, be used to evaluate the opening capability of the fuel tank ventilation valve. The case can, however, now arise that the HC-concentration of the gas mixture introduced by way of the fuel tank ventilation valve corresponds as far as possible to the concentration of the fuel-air-mixture adjusted by the $\lambda$-closed loop control. In this case no statement can be made about the functional efficiency of the fuel tank ventilation valve. Additional parameters must be used in this case to form a reliable statement, as described above in connection with the German patent DE 102 20 223 B4, for example, an increase in engine rotational speed, which can be used to evaluate the function of the fuel tank ventilation valve.

It is the task of the invention to embody a procedure for the functional diagnosis of an activateable fuel tank ventilation valve of a fuel tank system of an internal combustion engine to the effect, that a functional diagnosis is possible independent of the actual prevailing HC-concentration or expressed differently to embody a diagnostic procedure to test the functional capability of a fuel tank ventilation valve based on the HC-concentration to the effect, that it is universal, i.e. is deployable over the entire operating range of the internal combustion engine.

This task is solved with a procedure for the functional diagnosis of an activateable fuel tank ventilation valve of a fuel tank system of an internal combustion engine, especially a motor vehicle of the kind described at the beginning of the application, in that the HC-concentration of the regeneration gas is purposefully affected by changing the regeneration gas stream.

The basic idea of the invention is to adjust the HC-concentration in such a manner, that a random concurrence with the HC-concentration of the fuel-air-mixture, which is drawn in, can be ruled out with a very great likelihood.

Preferably the influence is based on the decreasing or increasing of the regeneration gas streams, especially their duration and size are changed.

In an advantageous form of embodiment, a large and long-lasting regeneration gas stream is set to implement a decrease of the HC-concentration, in order in this manner to rinse out the HC-molecules which have lodged in the active charcoal filter. Provision is made for this purpose in an advantageous form of embodiment to open the fuel tank ventilation valve in order to generate such a large and long-lasting regeneration gas stream.

Instead of a reduction of the HC-concentration, provision can also be made for an enlargement of the HC-concentration. According to an advantageous embodiment for the enlargement of the HC-concentration, the regeneration gas stream is preferably reduced entirely to zero.

Through reduction of the regeneration gas stream to zero, an outgassing takes place in the course of time in the tank, which leads to an accumulation of the HC-molecules in the active charcoal filter. A high HC-concentration is available in this case.

The generation of a reduced regeneration gas stream is preferably thereby implemented, in that the tank ventilation valve is at least partially closed. In the case of a reduction to zero, the tank ventilation valve is preferably completely closed.

Provision is made again in another embodiment of the procedure to implement an enlargement of the HC-concentration by producing a negative pressure in the fuel tank system. By means of such a negative pressure, an energization of the vaporization occurs and with it an enlargement of the HC-concentration. Purely in principle, the negative pressure can be produced in any desired manner. Provision is made in an advantageous embodiment to implement the production of the negative pressure in the fuel tank system by opening the tank ventilation valve while simultaneously closing the aeration valve of an active charcoal filter.

The operating parameter characteristic of the combustion can be in principle each of the operating parameters characteristic of the behavior of the combustion of fuel and intake air, respectively of fuel, intake air and regeneration gas. In an advantageous embodiment of the procedure, the air number $\lambda$ is used as the operating parameter. In this case, the $\lambda$ closed-loop control of the internal combustion engine can be used.

Additional advantages and characteristics of the invention are the subject matter of the following description as well as of the technical depiction of a preferred example of embodiment.

DRAWINGS

Figure 2:
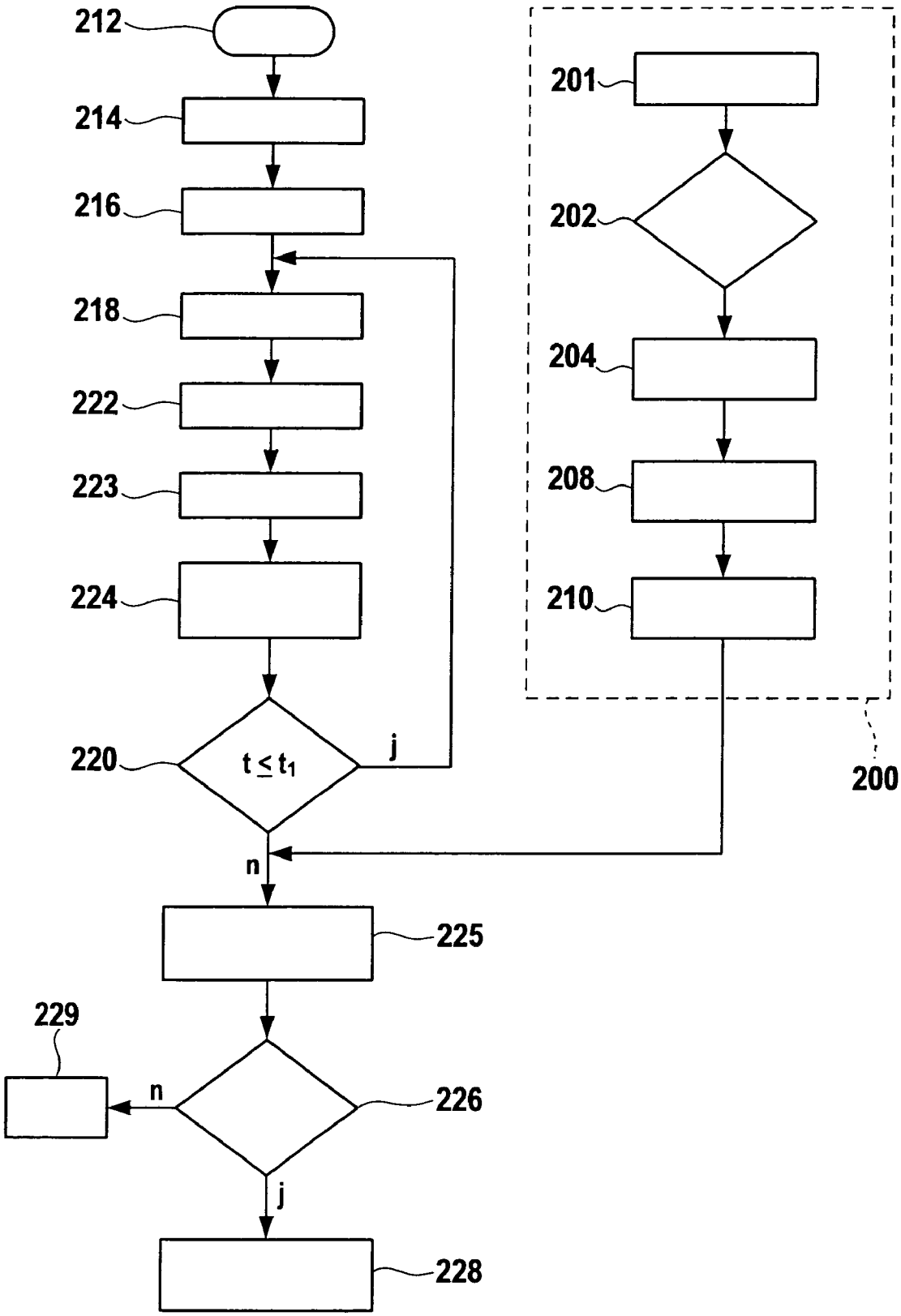
Figure 3:
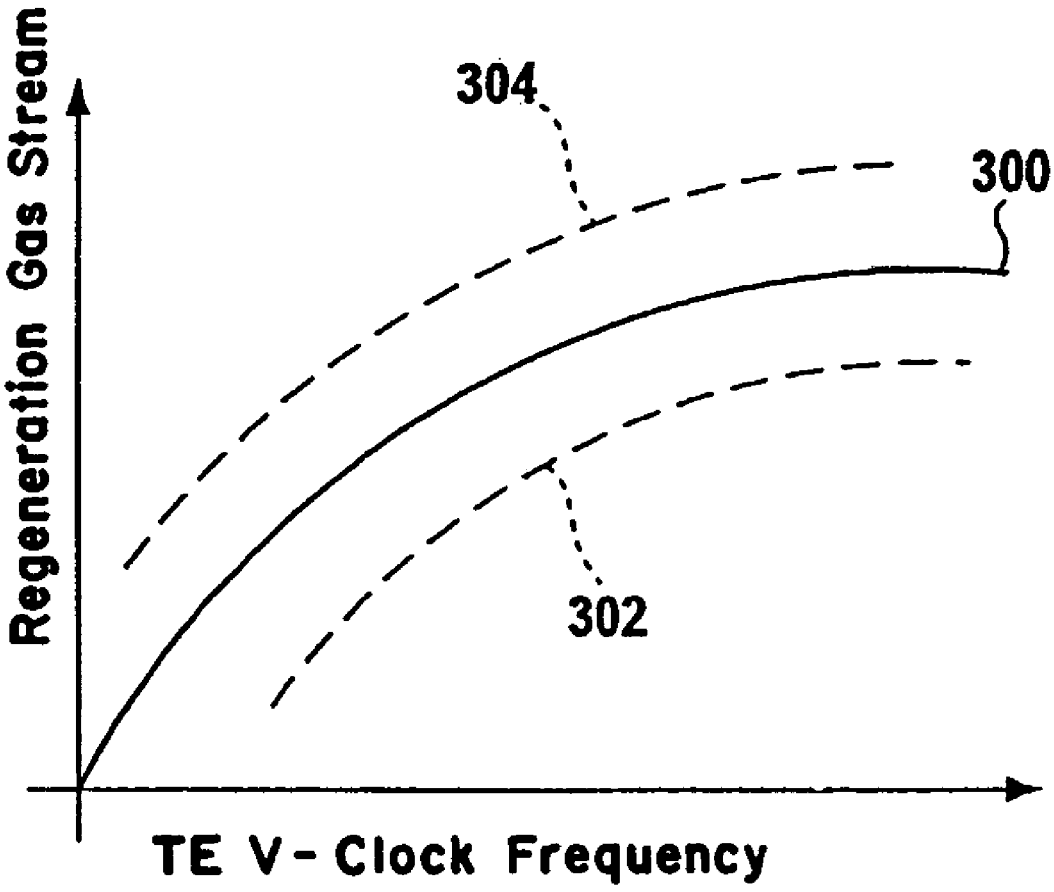

In the drawings are shown:

FIG. 1 schematically a fuel tank ventilation system known from the state of the art of a motor vehicle, in which a procedure made use of by the invention is applied;

FIG. 2 working steps according to the invention for the functional diagnosis of a fuel tank ventilation valve depicted in FIG. 1 using a flow diagram;

FIG. 3 schematically a typical curve family, which lies at the basis of the functional diagnosis according to the invention.

A fuel tank system depicted in FIG. 1 and common today in automobile production comprises a tank 10 with an aeration/ventilation connection, from which a tank connecting pipeline 12 leads to a fuel vapor accumulator 14, which normally is designed as a adsorption accumulator with active charcoal as an adsorber and denoted simply as an active charcoal filter (AKF). By way of a connecting pipeline 18, the active charcoal filter 14 is connected to an intake manifold, which has a damper flap, of an air intake system or with a fuel delivery system of an internal combustion engine.

The connecting pipeline 18 has especially a normally clocked activateable tank ventilation valve (TEV) 20, which opens the pipe when necessary, respectively closes it.

In the operation of the internal combustion engine 17 or when filling the tank, superficial hydrocarbon vapors (HC-vapors) form in the tank 10, which travel via the tank connecting pipe 12 into the active charcoal filter 14 and therein in a known manner are reversibly bonded.

By way of a tank ventilation valve 20 which is intermittently activated to open by a control unit 21 via a first electrical control lead 40 and by way of a switch valve 32, which via a second control lead is likewise activated to open, the active charcoal filter 14 is intermittently rinsed via the aforementioned connecting pipeline 18 by means of fresh air 22 transported from the surrounding ambient air into the active charcoal filter 14 for the regeneration, respectively desorption of the active charcoal filter.

The intermittent regeneration of the active charcoal filter 14 is therefore required, because the storage capacity of the active charcoal filter 14 continually decreases with an increasing amount of stored hydrocarbons. For this purpose, the active charcoal filter 14 is therefore connected by way of the fuel tank ventilation valve 20 with the air intake system 16 of the internal combustion engine. A pressure gradient between the active charcoal filter 14 and the air intake system 16 arises by the opening of the fuel tank ventilation valve 20. By means of this pressure gradient, the hydrocarbons stored in the active charcoal filter 14 are drawn into the air intake system 16 in order that they are finally combusted in the internal combustion engine 17 and thereby removed and simultaneously delivered to be recycled.

The fuel tank ventilation process described, including the regeneration of the active charcoal filter 14, is then most essentially dependent on the functional efficiency of the fuel tank ventilation valve 20.

In FIG. 2 procedural steps of a preferred example of embodiment of the functional diagnosis according to the invention of the fuel tank ventilation valve 20 shown in FIG. 1 are depicted in block diagram form.

The steps on the right side enclosed with a dashed line and designated with reference numbers are implemented in the planning stage to the actual functional diagnosis and serve to construct a curve family (FIG. 3) for the expected value of the mass flow rate across the fuel tank ventilation valve 20 as a function of the activation signal (here, for example, the clock frequency of the fuel tank ventilation valve 20). The mass flow rate across the tank ventilation valve 20 is subsequently also designated in short as the regeneration gas stream.

In the preliminary procedure 200, an altered HC-concentration is initially adjusted in step 201 in the subsequent more detailed manner of description. For example, this could be an elevated HC-concentration or a reduced HC-concentration. Then the fuel tank ventilation valve 20 is initially by means of an inherently known procedure, for example, by means of a procedure named in the introduction to the description, tested for its functional efficiency (Step 202). If functional efficiency is present, the fuel tank ventilation valve 20 is, for example, activated to open, step 204, in a time interval $t<t1$, which is empirically ascertained, and the behavior of the combustion of fuel and air is ascertained by the acquisition of the λ-value, whereby a characteristic curve of the regeneration gas stream as a function of the fuel tank ventilation valve-clock frequency is constructed in an inherently known manner. Additionally a range of tolerance is specified for the characteristic curve, step 210. FIG. 3 shows a typical characteristic curve for the application of the fuel tank ventilation function. The expected regeneration gas stream is plotted in the characteristic curve above the (primarily clocked activated) fuel tank ventilation control signal. The actual characteristic curve is designated with the number 300 and the stated tolerance ranges with 302 and 304.

It is to be noted, that the described unique preliminary procedure can also be dropped, if the ascertainment of the characteristic curve results metrologically during the calibration of the internal combustion engine.

The actual diagnostic routine implemented in the running operation of the internal combustion engine 17 after starting 212 affects from now on specifically in step 214 the HC-concentration, whereby it is understood, that the influence on the HC-concentration must correspond to those conducted in step 201 in the preliminary procedure 200. The influence can happen in most different manners. It is based on an enlargement or reduction of the fuel tank ventilation streams, i.e. their duration, respectively height and size are altered.

So, for example, a high and long-lasting mass flow rate is adjusted across the fuel tank ventilation valve for the reduction of the HC-concentration in order to rinse out the HC-molecules which have settled in the active charcoal filter.

On the other hand, the mass flow rate across the fuel tank ventilation valve 20 is reduced as far as possible, when possible even to zero, for an enlargement of the HC-concentration. In this case the outgassing in the tank provides for an accumulation of HC-molecules in the active charcoal filter 14. As a result a high HC-concentration is available for the subsequent diagnosis to be implemented.

Another possibility, to achieve an enlargement of the HC-concentration, is thereby implemented, in that the fuel tank ventilation valve 20 is opened, whereby simultaneously the active charcoal filter aeration valve 32 is closed. In this case a negative pressure is produced in the fuel tank, which leads to an enlargement of the HC-concentration by the outgassing of the HC-molecules.

Initially the λ-value or another operating parameter characteristic of the combustion of the fuel-air-mixture is buffered (buffer store). The operating parameter must, however, correspond to those, which were used in the preliminary procedure.

Subsequently in step 218, the fuel tank ventilation valve is activated to open. During the activation of opening the fuel tank ventilation valve 20, the operating parameter characteristic of the behavior of the combustion in the combustion chamber is acquired, step 222. In this case, the operating parameter would be the λ-value. By comparison of the actually acquired operating parameter with the value of the operating parameter, which was buffered, the changes to the operating parameter resulting from the change of the HC-concentration are initially ascertained, step 223, and in connection with that, the regeneration gas stream is calculated from these changes to the operating parameter, step 224. On the basis of the inquiry 220 and the associated loop, the stated steps 218, 222, 223, 224 are repeatedly implemented only up to the operational sequence of the time interval t<t1. The aforementioned steps 218, 222, 223, 224 are correspondingly repeatedly implemented so long until a specifiable time interval t1 is exceeded. The parameter t1 is empirically to be ascertained in advance and is determined in a way that the required system reaction can result through the change to the HC-concentration.

The value of the regeneration gas flow rate, which is calculated in the manner stated above, is then compared with the already present characteristic curve 208, 210, step 225. If the calculated air mass flow rate lies within the range of tolerance specified in the curve family, step 226 (FIG. 3), a positive diagnostic result is assumed, i.e. a functionally efficient fuel tank ventilation valve 20, and a corresponding signal is transmitted, step 228. Otherwise a negative diagnostic result is assumed, i.e. a functionally inefficient fuel tank ventilation valve, and a corresponding signal is indicated, step 229.

The basic idea of the invention is to specifically influence the HC-concentration in the regeneration gas stream, in order to, thus, prevent the targeted influencing toward rich or lean through the targeted influencing of the HC-concentration, so that the HC-concentration, which is supplied to the internal combustion engine by the regeneration gas stream, corresponds to those supplied to it without a regeneration gas stream. In other words random correlations of the HC-concentration of the fuel-air-mixture supplied to the internal combustion engine with and without a regeneration gas stream should be prevented. Because of this, additional diagnoses are superfluous, for example on the basis of changing the energy stream (air mass flow rate/ignition angle), as this change, for example, proceeds from the previously described German patent DE 102 20 223 B4. Moreover, large changes can be produced by a change of the HC-concentration in the complete mixture, i.e. operating conditions, in which up until now the HC-concentration in the complete mixture came out to small, can also be used in this manner.

It is a particular advantage, that the diagnostic test can also be used in the partial load range and not only in the idle operation, as is known from the state of the art. In this manner, the operating window of the exhaust gas test, which up until now has been only narrow, is significantly enlarged. This represents a significant step toward the implementation of future demands of the exhaust gas diagnostic legislation (On-Board-Diagnosis II, OBD II).

It is most especially advantageous, that the described procedure makes do without additional diagnostic control devices and memories and the like. Inherently known engine management systems can be deployed for the implementation of the procedure.

The invention claimed is:

1. A method for the functional diagnosis of an activateable fuel tank ventilation valve of a fuel tank system of an internal combustion engine, especially of a motor vehicle, the method comprising:

adding regeneration gas to air drawn into a combustion chamber in specifiable time intervals when the fuel tank ventilation valve has been activated to open;

delivering fuel to the combustion chamber;

combusting the fuel, the air, and the regeneration gas in the combustion chamber;

comparing at least a first parameter, which characterizes combustion of fuel and intake air, with a second parameter, which characterizes combustion of fuel, intake air and regeneration gas;

calculating the regeneration gas stream from the changes between the first parameter and the second parameter, wherein the HC-concentration of the regeneration gas is specifically affected by changing the regeneration gas stream;

comparing the calculated regeneration gas stream with a pre-determined characteristic curve of a fuel tank ventilation function;

inferring the fuel tank ventilation valve being functionally efficient if the calculated regeneration gas stream is within a range of tolerance specified in the characteristic curve; and inferring the fuel tank ventilation valve being functionally inefficient if the calculated regeneration gas stream is not within a range of tolerance specified in the characteristic curve.

2. A method according to claim 1, further comprising altering a duration and a size of the regeneration gas stream.

3. A method according to claim 1, further comprising setting a larger and long-lasting regeneration stream to implement a reduction of the HC-concentration.

4. A method according to claim 3, further comprising opening the tank ventilation valve in order to generate a large and long lasting regeneration gas stream.

5. A method according to claim 1, further comprising reducing the regeneration gas stream preferably to zero in order to enlarge the HC-concentration.

6. A method according to claim 5, further comprising at least partially closing the fuel tank ventilation valve in order to generate a reduced regeneration gas stream.

7. A method according to claim 1, further comprising producing a negative pressure in the fuel tank system in order to implement an enlargement of the HC-concentration.

8. A method according to claim 7, further comprising opening the fuel tank ventilation valve while simultaneously closing an aeration valve of an active charcoal filter in order to produce negative pressure in the fuel tank system.

9. A method according to claim 1, wherein at least one of the first and second parameters is the air number λ.

* * * * *